United States Patent [19]

Reynard

[11] Patent Number: 4,768,905

[45] Date of Patent: Sep. 6, 1988

[54] APPARATUS FOR SECURING CONTAINERS END TO END

[75] Inventor: Kenneth Reynard, Thirsk, England

[73] Assignee: George Blair Public Limited Company, England

[21] Appl. No.: 118,462

[22] Filed: Nov. 6, 1987

[30] Foreign Application Priority Data

Nov. 17, 1986 [GB] United Kingdom ..... 8627454

[51] Int. Cl.[4] ..... B60P 7/13

[52] U.S. Cl. ..... 410/78; 24/287; 220/1.5; 220/23.4; 403/330

[58] Field of Search ..... 410/77–84, 410/52, 156; 24/287; 248/503, 500; 206/512, 511, 509; 220/1.5, 23.4; 403/330, 322, 361

[56] References Cited

U.S. PATENT DOCUMENTS

| | | | |
|---|---|---|---|
| 2,972,175 | 2/1961 | Abolins | 24/287 |
| 3,718,218 | 2/1973 | Shields | 206/512 |
| 3,734,442 | 5/1973 | Lunde | 410/77 |
| 4,352,517 | 10/1982 | Bertolini | 410/81 |
| 4,431,368 | 2/1984 | Katz et al. | 410/78 |

*Primary Examiner*—Robert B. Reeves
*Assistant Examiner*—Joseph D. Pape
*Attorney, Agent, or Firm*—Abelman Frayne Rezac & Schwab

[57] ABSTRACT

Device for securing together, in end-to-end relationship, a pair of containers each provided with apertures of predetermined sizes and locations adjacent the corners of the end walls thereof, including a female member having a hollow body portion and a locking portion pivotally mounted on the body portion and having a surface forming a continuation of the bore through the body portion. A male member of the securing device includes a shaft portion for location within the bore of the female member and provided with a surface thereon co-operating with that on the locking portion of the female member in the operative position of the securing device to prevent relative movement between the male and female members and to secure the containers together between flange flanges on the male and female members.

7 Claims, 2 Drawing Sheets

APPARATUS FOR SECURING CONTAINERS END TO END

BACKGROUND OF THE INVENTION

This invention relates to means for securing together containers and has particular, though not exclusive, application to such means for co-operating with the corner fittings of standard freight containers.

Freight containers are produced in a series of standard sizes and are known as I.S.0. containers. These containers are provided with corner fittings each of which comprises a hollow, generally box-shaped component provided with apertures in the outwardly facing walls thereof for receiving therein releasable securing means. Hereinafter any reference to a corner fitting is to be understood as referring to a corner fitting of the above-described type.

It is conventional practice to transport large numbers of such containers, usually a mix of 20 feet long and 40 feet long containers, on board ships with laterally adjacent containers interconnected with one another to form a stable block of containers.

It is also conventional practice to provide a matrix of upright steel columns or cell guides throughout the ship for locating the containers prior to interconnection, and clearly the precise location of these columns will depend upon the length of the containers to be transported. Thus, with a mixed load of 20 feet and 40 feet containers, it is necessary to provide cell guides some of which are spaced 20 feet apart and some of which are spaced 40 feet apart.

The fitting and removal of these upright steel columns is a tedious and time-consuming exercise which considerably increases the turnround time of the vessels in port.

It would be much more convenient to be able to provid a matrix of fixed-positioned cell guides but which still provided the necessary location for containers of different sizes and which therefore eliminated the necessity for fitting and removing guides in dependence upon the sizes of the containers to be transported.

This could be achieved by locating the cell guides at a spacing equal to the length of the longest containers to be transported, usually 40 feet, and by providing means for securing together end-to-end two 20 feet long freight containers into a 40 feet long unit capable of withstanding the loads associated with shipping.

SUMMARY OF THE INVENTION

According to the present invention there is provided means for securing together, in end-to-end relationship, a pair of containers each provided with apertures of predetermined size and location adjacent the corners of the end walls thereof, the means comprising a female member having a hollow body portion for location within aligned apertures in the adjacent end walls of the containers and the shape of the transverse section of which body portion conforms substantially with that of at least part of the defining walls of said apertures, flange means on said body portion for abutment with the inner face of the end wall of one of said containers to locate the female member axially in an operative position, and a locking portion pivotally mounted on said body portion and including a surface thereon form an axial continuation of part of the defining surface of the bore through the body portion, the means further comprising a male member having a shaft portion for location within the body portion of the female member and flange mean for abutment with the inner face of the end wall of the other container to locate the male member in an operative position, the shaft portion including a surface thereon the configuration of which, with the male and female members in their operative positions, co-operates with that of the surface on the locking portion of the female member to prevent relative movement between the male and female member and thereby to secure the containers together.

In the case of freight containers each provided with corner fittings of the type described, the apertures receiving the securing means are formed in the adjacent end walls of the corner fittings.

It will thus be appreciated that, with such arrangements, the securing means are positively located within the aligned apertures of the containers or the corner fittings by co-operation between the defining walls of the apertures and the closely fitting body portion of the female member, while the co-operating surfaces of the locking portion and the shaft portion serve to retain the male and female members in positions such that the adjacent walls of the two containers are securely retained between the flange means on the male and female members.

Preferably said surfaces on the locking portion of the female member and on the shaft portion of the male member are serrated with the teeth thereon being undercut to create a ratchet action which permits ready insertion of the shaft portion of the male member into the bore of the body portion of the female member but prevents removal therefrom.

Conveniently the female member is provided with resilient means which urge the serrated surface of the pivotal locking portion into engagement with the serrated surface on the shaft portion of the male member.

Conveniently, the locking portion of the female member includes a lever arm to facilitate pivoting movement of said locking portion against the resilient means to disengage the serrated surface thereon from the serrated surface of the shaft portion of the male member.

Preferably at least the male member and the locking portion of the female member are of hardened steel, while the body portion of the female member may be of mild steel.

In one embodiment of the invention, the body portion of the female member, in the operative position of said member, extends through the aperture in the end wall of the one container and through at least part of the depth of the aperture in the end wall of the other container.

DESCRIPTION OF THE PREFERRED EMBODIMENT

Figure 1:
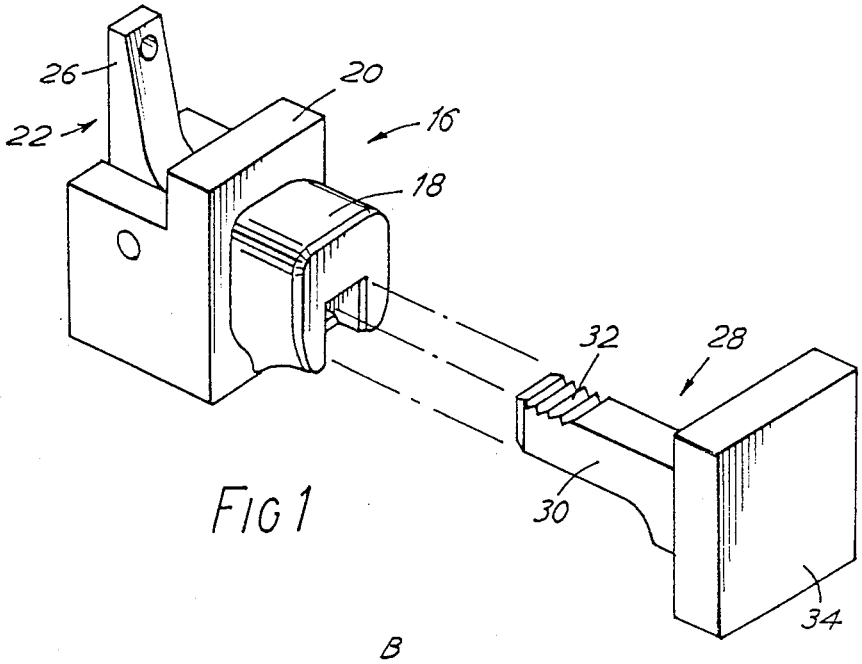
FIG. 1 is a perspective view of securing means according to the invention.

Referring to the drawings, there are shown two conventional corner fittings indicated generally at 2 and 2', one located at the corner of each of two end-to-end abutting I.S.O. freight containers. Each corner fitting comprises a hollow steel casting of predetermined dimension and provided with conventionally-shaped apertures in some of the walls thereof, including a substantially symmetric aperture 4 in the end wall 6 thereof, a longitudinally elongate aperture 8 in the top wall 10 thereof, and a vertically elongate aperture 12 in the sidewall 14 thereof.

Figure 2:
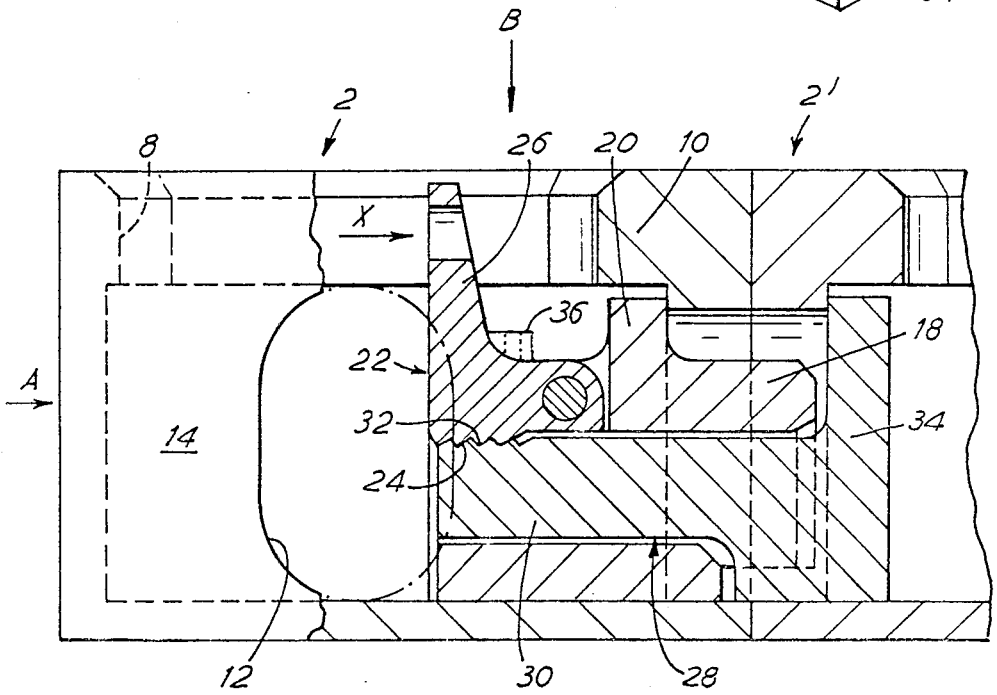
FIG. 2 is a longitudinal vertical section through securing means according to the invention in an operative position securing two corner castings together.
Figure 3:
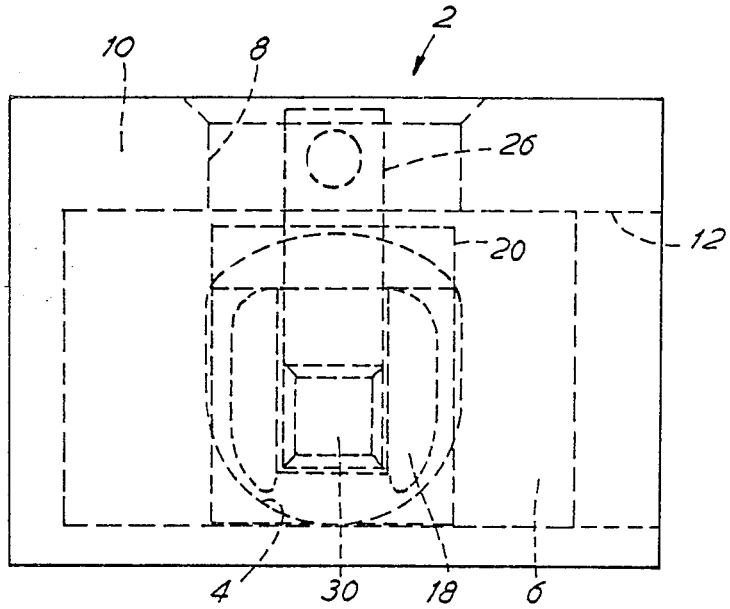
FIG. 3 is an end view in the direction of arrow 'A' in FIG. 2.
Figure 4:
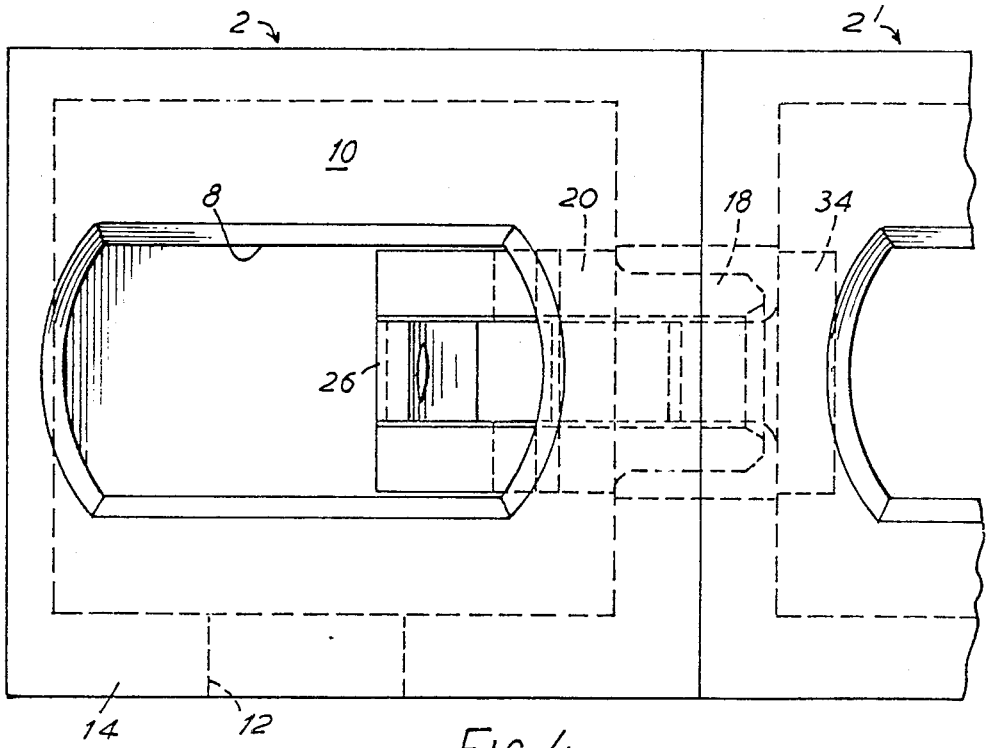
FIG. 4 is a plan view from above in the direction of arrow 'B' in FIG. 2.

The means for securing together two adjacent corner fittings in end-to-end relationship comprises a female member indicated generally at 16 and including a hollow body portion 18 shaped to be a close fit in the aperture 4 in the end wall of the corner fitting 2' as best seen in FIG. 2. The body portion 18 is bounded by an increased-sized flange 20 the front face of which is adapted to abut the inner face of the end wall 6 of the corner fitting 2 to determine the operative position of the female member 16.

Pivotally mounted adjacent the rear end of the body portion 18 of the female member 16 is a locking portion 22 having a serrated locking surface 24 which forms a continuation of the upper surface of the bore through the body portion 18. The locking portion 22 further includes an upwardly extending lever arm 26 for facilitating pivoting movement of the locking portion 22 in a clockwise direction from its operative position shown in the drawings as will be described in more detail below.

The securing means further comprises a male member indicated generally at 28 and including an elongate shaft portion 30 for insertion into the hollow body portion 18 of the female member 16 and having a serrated upper surface 32 and an increased-sized head portion 34 the front surface of which is adapted to abut the inner face of the end wall of the corner fitting 2' to determine the operative position of the male member 28.

The securing means described above operate as follows.

With the end walls 6 of the corner fittings 2,2' abutting one another and with the apertures 4 therein aligned with one another, the female member 16 is inserted through the aperture 8 in the top wall 10 of the corner casting 2 into the interior of the casting and the body portion 18 thereof is located through the aligned apertures 4 until the flange 20 abuts the inner face of the end wall 8 of the casting 2.

The male member 28 is then similarly located in the interior of the corner casting 2' and the shaft portion 30 thereof is inserted into the bore in the body portion 18 of the female member 16. As the shaft portion 30 is pushed through said bore, the serrated surfaces 24,32 on the locking portion 22 of the female member and on the shaft portion 30 co-operate with one another, the undercut nature of the teeth on said surfaces 24, 32 being such as to create a ratchet action therebetween whereby the shaft portion 30 can readily be inserted into the body portion 18 but cannot be removed therefrom.

More particularly, the serrated surface 24 of the locking portion 22 is arranged to be urged, either by gravity under the effect of the weight of the locking portion 22, or by resilient means 36, into engagement with the surface 32 of the shaft portion 30 to effect a positive locking action therebetween in one direction.

The operative position of the securing means is then achieved when the head portion 34 of the male member abuts the inner face of the end wall 8 of the casting 2', in which position the abutting end walls 8 of the corner castings 2,2' are securely retained together between the flange 20 of the female member 16 and the head portion 34 of the male member 28 with the co-operating teeth of the surfaces 24,32 preventing any relative movement between the male and female members 28 and 16 such as could unsecure the castings from one another.

If there is no loading on the associated containers, release of the securing means can be effected merely by manual pivoting of the lever arm 26 of the female member 16 in a clockwise direction as viewed in FIG. 2 to release the surface 24 of the locking portion 22 from the surface 32 of the shaft portion 30 of the male member 28.

If, on the other hand, the associated containers are loaded such that there are forces trying to move the containers apart, release of the securing means is effected by hammering against the free end of the lever arm 26 in the direction of arrow 'X' in FIG. 2 to initially disengage the teeth of the serrated surfaces 24, 32 from one another. Thereafter, and once the containers have moved to the unloaded position, the lever arm 26 can be moved manually as above and final release can be achieved.

The components of the securing means can be forged, cast or machined, while it is preferred that at least the male member 28 and the locking portion 22 of the female member 16— i.e. the components subjected to substantial forces — are formed from heat treated, hardened and tempered steel. The body portion 18 of the female member may be of mild steel.

Thus there are provided means for securing together freight containers in end-to-end relationship which are completely housed within the associated containers and which, by virtue of the close fit of the body portion 18 of the female member 16 in the aligned apertures 4 and the provision of the bearing surfaces formed on the flange 20 and head portion 34, are capable of withstanding the loads and forces associated with the transport and shipping of the containers.

This enables two 20 feet containers to be interconnected and subsequently treated as a 40 feet unit with the consequential elimination of the guide cells otherwise needed for the transportation of 20 feet containers on board ship.

The dimensions of the components of the securing means, and in particular the body portion 18, are chosen to enable their application to corner castings and freight containers manufactured within all permissible tolerance ranges.

In certain situations, the combined length of two containers each of nominal 20 feet length may not be exactly 40 feet and may typically be 39 feet 9 inches. In such cases, spacer members each of three inch thickness are provided for location between each pair of adjacent corner castings of the two containers to be connected, each spacer member being apertured to receive therethrough the shaft portion 30 of the associated male connecting member 28, the length of which shaft portion is increased by three inches to accommodate thereon the spacer member.

Although described in relation to the shipping of freight containers, the securing means of the invention are equally applicable to the interconnection of modular units in the military and industrial fields. In such cases, the corner regions of the end walls of such units to be interconnected are provided with apertures substantially conforming in shape with those in the end walls of the corner fittings of the freight containers detailed above.

What I claim and desire to secure by Letters Patent is:

1. Means for securing together a pair of freight containers in end-to-end relationship, each container, having end walls defining therein apertures of predetermined size and location adjacent the corners thereof, the securing means comprising a female member having an axial bore within an elongate body portion for location within aligned apertures in the end walls of adacent containers, and the shape of a transverse section of said body portion conforms substantially with that of at least part of the defining walls of said apertures, flange means on said body portion for abutment with the inner face of the end wall of one of said containers to locate the female member axially in an operative position, and a locking portion pivotally mounted on said body portion and including a surface thereon forming an axial continuation of a part of the bore through the body portion, the securing means further comprising a male member having a shaft portion for location within the axial bore of the female member and flange means for abutment with the inner face of the end wall of the other container to locate the male member in an operative position, the shaft portion including a surface thereon the configuration of which, with the male and female members in their operative positions, co-operates with that of the surface of the locking portion of the female member to prevent relative movement between the male and female members and thereby to secure the containers together.

2. Securing means as claimed in claim 1 in which serrations are formed on the surfaces of the locking portion of the female member and the shaft portion of the male member, the teeth of said serrations being undercut to create a ratchet action which permits ready insertion of the shaft portion of the male member into the axial bore of the body portion of the female member but prevents removal therefrom.

3. Securing means as claimed in claim 2 and further including resilient means urging the serrated surface of the pivotal locking portion of the female member into engagement with the serrated surface on the shaft portion of the male member.

4. Securing means as claimed in claim 3 in which the locking portion of the female member includes a lever arm to facilitate pivoting movement of said locking portion against the resilient means to disengage the serrated surface thereon from the serrated surface on the shaft portion of the male member.

5. Securing means as claimed in claim 1 in which the male member and the locking portion of the female member are of hardened steel and the body portion of the female member is of mild steel.

6. Securing means as claimed in claim 1 in which the body portion of the female member, in the operative position of the female member, extends through the aperture in the end wall of the one container and through at least part of the depth of the aperture in the end wall of the other container.

7. Securing means as claimed in claim 1 for freight containers each provided with corner fittings, the apertures receiving the securing means being formed in the adjacent end walls of the corner fittings.

* * * * *